US005870803A

United States Patent [19]

Jorst

[11] Patent Number: 5,870,803

[45] Date of Patent: Feb. 16, 1999

[54] DOUBLE-LOCKING CLASP FOR WATCH BAND

[76] Inventor: Charlotte Kjoelbye Jorst, 867 Donna Dr., Incline Village, Nev. 89451

[21] Appl. No.: 2,052

[22] Filed: Dec. 31, 1997

[51] Int. Cl.[6] ..... A44C 5/20; A44B 1/04

[52] U.S. Cl. ..... 24/265 WS; 24/265 BC; 24/265 EC

[58] Field of Search ..... 24/265 WS, 265 EC, 24/265 BC, 265 R, 71 R, 316, 318, 319

[56] References Cited

U.S. PATENT DOCUMENTS

| | | | |
|---|---|---|---|
| 2,211,018 | 8/1940 | Levine . | |
| 3,425,104 | 2/1969 | Mochizuki | 24/265 WS X |
| 3,585,744 | 6/1971 | Arnone . | |
| 3,636,596 | 1/1972 | Iizuka | 24/265 WS X |
| 3,711,906 | 1/1973 | Leon . | |
| 3,797,716 | 3/1974 | Mochizuki | 24/265 WS X |
| 4,158,904 | 6/1979 | Learn | 24/265 WS X |
| 4,288,892 | 9/1981 | Mardirossian . | |
| 4,296,532 | 10/1981 | Ho . | |
| 4,332,061 | 6/1982 | Rieth et al. | 24/265 WS X |
| 4,359,808 | 11/1982 | Fontaine | 24/265 WS X |
| 4,382,318 | 5/1983 | Takmoto | 24/265 WS X |
| 4,675,955 | 6/1987 | Nakamura | 24/265 WS X |
| 5,042,115 | 8/1991 | Dumas et al. . | |
| 5,191,685 | 3/1993 | Aoki et al. | 24/265 WS X |
| 5,305,503 | 4/1994 | Yamagata . | |

FOREIGN PATENT DOCUMENTS

| | | | |
|---|---|---|---|
| 1191795 | 5/1970 | United Kingdom . | |
| 2038917 | 7/1980 | United Kingdom | 24/265 WS |

*Primary Examiner*—Anthony Knight
*Assistant Examiner*—Robert J. Sandy
*Attorney, Agent, or Firm*—Abelman, Frayne & Schwab

[57] ABSTRACT

A metal locking clasp for securing the free ends of watch bands, bracelets and the like, having a hook and bar joining mechanism that is held in place with a first pivoting lock plate and depending lock element, is provided with a second locking mechanism that is pivotally mounted for rotation from an open position that is displaced from the closed lock plate to a locked position. The second locking mechanism consists of a cover plate and a pair of depending pivot arms, the arms being mounted in the clasp frame sidewalls at the end oppose the free end of the band. The second locking mechanism is secured by engagement of projecting elements, such as bosses, which extend between the sidewalls and pivot arms and engage openings or recesses in the adjacent surface.

16 Claims, 5 Drawing Sheets

33
30
32
34
58
38
44
4
50
56
54
10
17
14
16
40
52
42
58
36
60
20
2
14
18
26
22
24
19
12

50
34
32
26
17
16
14
38
4
2
12
14
42

FIG.5
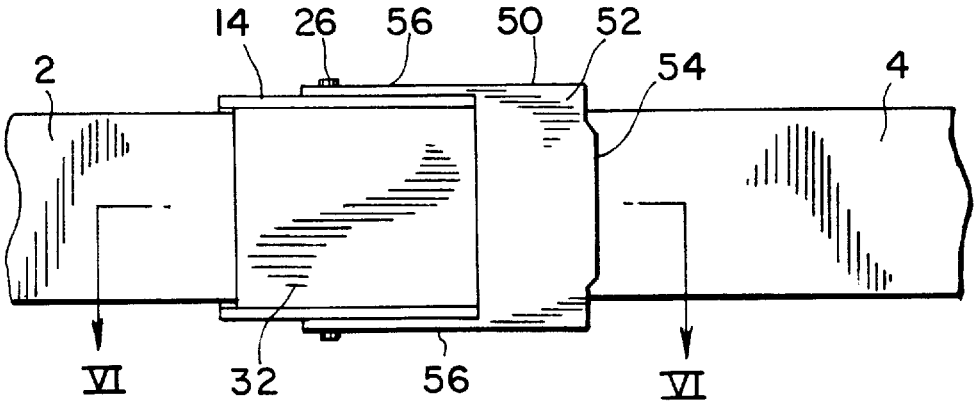
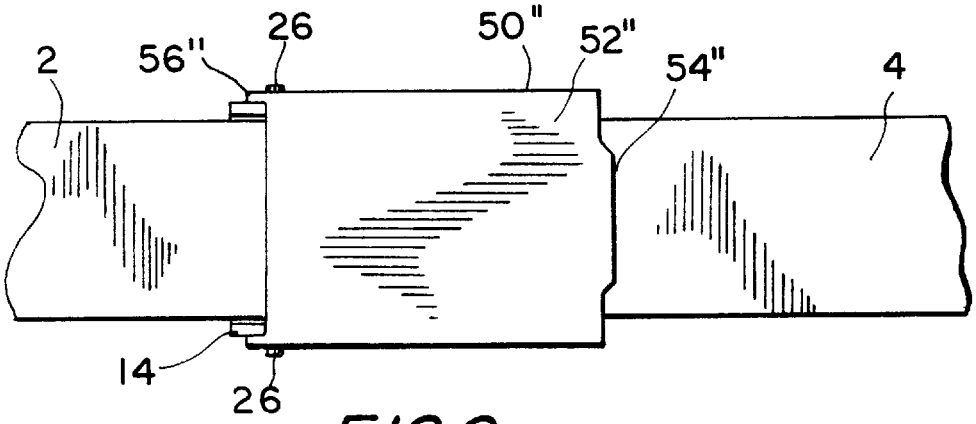
FIG.8

DOUBLE-LOCKING CLASP FOR WATCH BAND

FIELD OF THE INVENTION

The invention relates to metal locking clasps for joining the free ends of watch bands, bracelets and the like.

BACKGROUND OF THE INVENTION

A variety of mechanisms have been employed for joining and securing the free ends of watch bands and bracelets. One form of metal clasp that is in wide-spread use for joining and securing the ends of flexible metal mesh watch bands comprises a first element in the form of a U-shaped frame member adapted to receive a section of one of the bands and which includes a clamping mechanism to releasably secure the frame member at a predetermined position on a section of the band. A second joining member is permanently secured to the terminus of the free end of the second band. In order to permit the wearer to initially join the free ends, a combination of a transverse bar or pin and a hook member are respectively provided on the free ends of the band. The initial hook and bar connection allows the wearer to determine that the fit is appropriate, and this initial joining step can be facilitated by use of a pivoting locking plate. After the hook has been placed over the bar, the pivoting locking plate is rotated to secure the locking mechanism. Representative structures for this type of metal locking clasp are shown in U.S. Pat. Nos. 4,359,808; 3,425,104 and others.

Although generally reliable, the locking clasps of the prior art have only a single locking mechanism and that mechanism can be unintentionally released when the pivoting locking plate is accidently opened. Once the locking plate is lifted, the hook is easily displaced from the bar and the free ends separate. It would therefore be desirable to provide a locking clasp having a second or safety lock that would prevent the accidental inadvertent opening of the first or primary lock.

It is therefore an object of this invention to provide an improved metal clasp for joining the free ends of watch bands, bracelets and the like which has a double-locking mechanism to provide protection against the inadvertent unlocking of the clasp and the potential loss or damage to the watch.

It is another object of the invention to provide a double-locking metal safety clasp which is compact and aesthetically attractive, and which at the same time, is relatively simple in its mode of operation, as well as in its construction, and which is therefore economical to manufacture.

It is yet another object of this invention to provide a double-locking metal safety clasp in which a second locking mechanism can be adapted for use with single lock clasps with a minimum of retooling for their manufacture.

SUMMARY OF THE INVENTION

In its broadest context, the invention comprehends an apparatus and method for providing a second safety locking mechanism for use with various prior art clasp assemblies having a hook and bar mechanism held in place by a pivoting lock plate. The second locking member of the invention is pivotally mounted on the sidewalls of the stationary frame member at the end opposite the first pivoting lock plate, and along a transverse axis of rotation. The second locking action is the result of the engagement of a plurality of projecting elements extending between the frame sidewalls and a pair of pivot arms comprising a part of the second locking mechanism. The projecting members are preferably a plurality of bosses that engage corresponding openings or recesses in the adjacent structure to thereby secure a cover plate mounted between the pivot arms of the second locking mechanism in a position above the first locking mechanism.

The method contemplates rotating a cover plate joined to pivot arms that are pivotally mounted on the sidewalls of a frame member from an open position that is displaced from the secured lock plate of a first locking mechanism, to a closed and locked position that is superposed above and in close proximity to the lock plate, thereby preventing the first locking mechanism to be accidentally or inadvertently dislodged.

More specifically, the double-locking safety clasp of the invention comprises a frame member for receiving and retaining a section of a first band between a pair of sidewalls and a bar extending between the sidewalls of the frame member, a first locking member pivotally joined to the free end of a second section of the band, a hook member pivotally joined to the free end of the band along an axis of rotation coincident with that of the first locking member, said hook member adapted to engage the bar on the frame member, lock engagement means on the frame member for engaging the first locking member to releasably secure the first locking member to the frame member, a second locking member pivotally mounted on the sidewalls for rotation to a locked position overlying the secured first locking member, and a plurality of bosses extending between the sidewalls and the second locking member and a corresponding plurality of openings adapted to engage said bosses to releasably secure the second locking member to said frame member in a locked position.

The method of the invention for double-locking the is free ends of a watch band or bracelet comprises the steps of:

providing a generally U-shaped frame member comprising a base and longitudinal sidewalls, a transverse bar extending between said sidewalls and a first lock engaging means;

securing a section of a first band to the frame member between the sidewalls;

providing a lock plate comprising a first locking element;

providing a hook member;

pivotally mounting the lock plate and the hook member on the end of the second band;

providing a second locking member comprising a cover plate and a pair of opposing pivot arms extending from said cover plate, one end of said pivot arms being configured for mounting on said frame member;

mounting the ends of said opposing pivot arms on said sidewalls for rotation from an open to a closed position; engaging said hook member on the transverse bar of the frame member;

rotating the lock plate to engage the first locking element with the engaging means to secure the lock plate to the frame member in a first locking action;

providing each of the pivot arms and/or the adjacent sidewalls with at least one boss to engage a corresponding opening in the other;

rotating the second locking member to position said cover plate over the first lock plate and said pivot arms adjacent said sidewalls; and engaging the bosses in the corresponding openings in the adjacent structure to thereby lock said second locking member in position.

BRIEF DESCRIPTION OF THE DRAWINGS

The above objects and other advantages of the invention and its preferred embodiments will be understood from the description which follows and the attached drawings in which

FIG. 5 is a top view of the embodiment of FIG. 4;

FIG. 8 is a top plan view of yet another preferred embodiment of the invention.

DETAILED DESCRIPTION OF THE INVENTION

Figure 1:
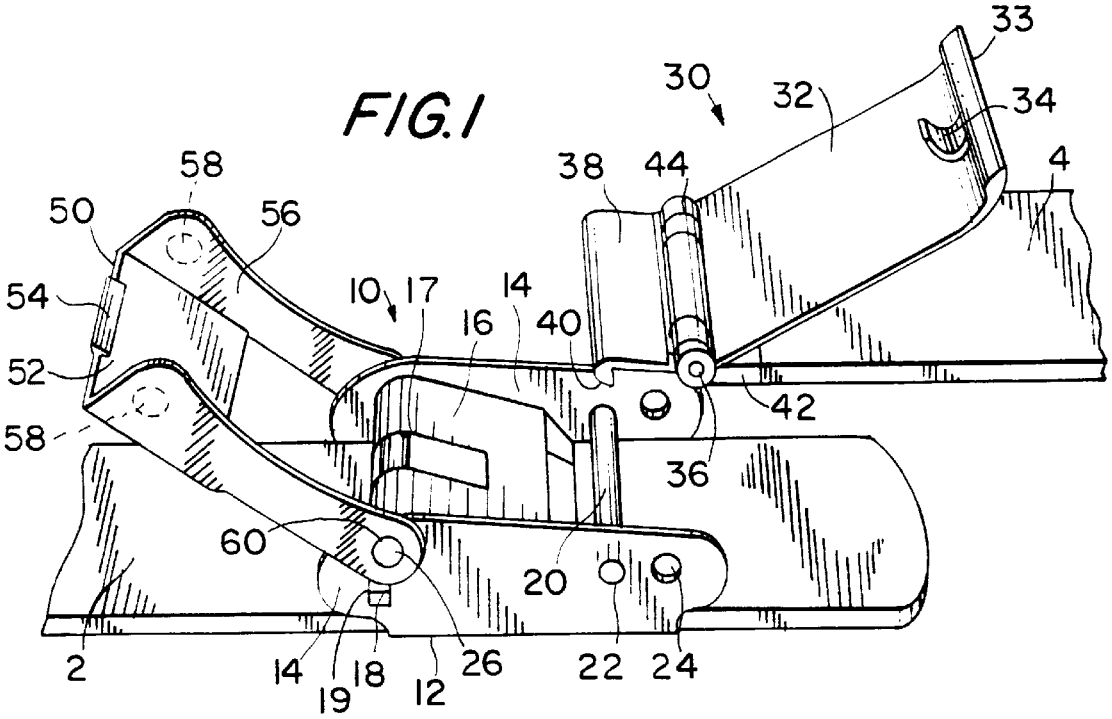
FIG. 1 is a front perspective view showing one preferred embodiment of the invention assembled to the free ends of a watch band or bracelet preparatory to joining them.

With reference to the series of drawings of FIGS. 1–4 there is shown the free ends 2 and 4 of a watch band, bracelet or the like (hereafter referred to as bands for convenience.) With reference to FIG. 1, the receiving member 10 is comprised of a U-shaped metal frame member 12 formed with a base plate 13 and a pair of upstanding sidewalls 14. The base plate is of a width sufficient to receive a section of the band between the sidewalls. The sidewalls are configured and finished to eliminate sharp corners and edges which might snag or otherwise damage the wearer's clothing. The strap 2 is adjustably secured to the frame member by pressure plate 18 which is held in place by plate clamp 16 which is mounted for rotation about pivot pin or transverse axle 26. Pressure plate 18 is positioned between the sidewalls 14 by transverse lugs which extend into plate aperture 17 in sidewalls. Plate clamp 16 is produced from a resilient metal and in the closed position exerts a biasing force against the pressure plate 18 to urge it against band 2.

A transverse stationary bar 20 extends between apertures 22 in sidewalls 14.

With continuing reference to FIG. 1, first locking assembly 30 is comprised of lock plate 32 with depending first locking element 34. The leading edge 33 of lock plate 32 can be turned or otherwise finished to provide a smooth rim to permit it to be lifted from the locked position, e.g., by a fingernail. Lock plate 32 is pivotally mounted on transverse pin 36. Also pivotally mounted on pin 36 is hook plate 38 which terminates in curved end 40 which is configured to engage stationary bar 20 on receiving member 10. The terminus of the free end of band 4 is likewise secured to pin 36 by fixed band attachment clamp 42 and attachment clamp fingers 44.

Figure 2:
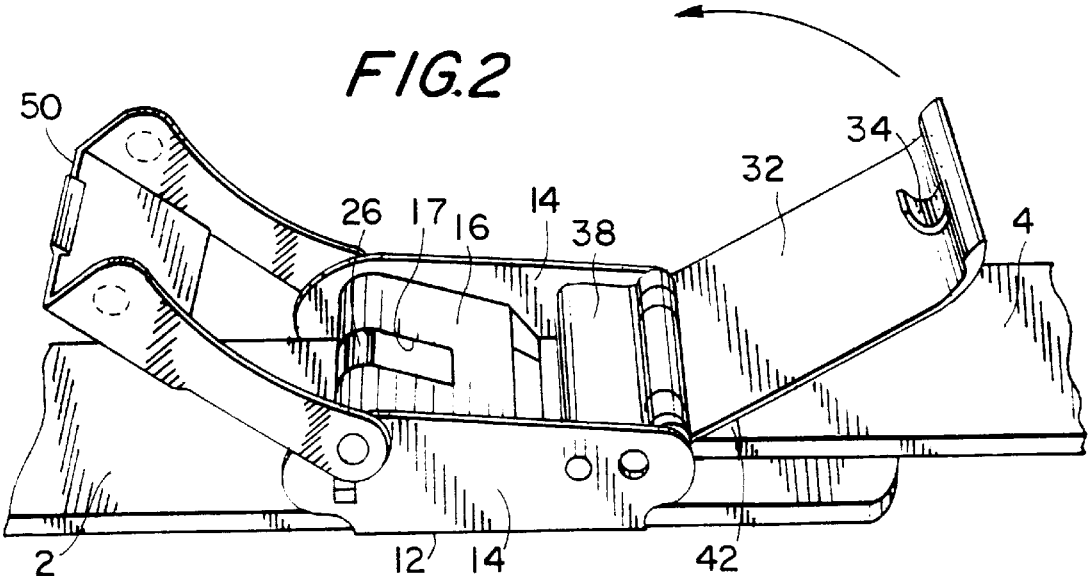
FIG. 2 is a front perspective view of the invention of FIG. 1 in a partially assembled position.

With reference to FIGS. 1 and 2, the curved end 40 of hook plate 38 is placed around stationary bar 20 as the first step in joining the free ends of the band. This step can be facilitated by moving the free end of band 4 into position by holding the lock plate 32 between the thumb and forefinger. Lock plate 32 is then rotated in the direction illustrated in FIG. 2 until first locking element 34 engages the exposed section of pivot pin 26. As shown in FIGS. 1 and 2, aperture 17 is provided in plate clamp 16 to expose a section of pivot pin 26 for engagement by the curved surface of locking element 34. It will be appreciated that the first locking element can comprise more than one depending biased element and that the plate clamp can be provided with a corresponding number of apertures to permit engagement of the plurality of locking element with the pivot pin 26.

Figure 3:
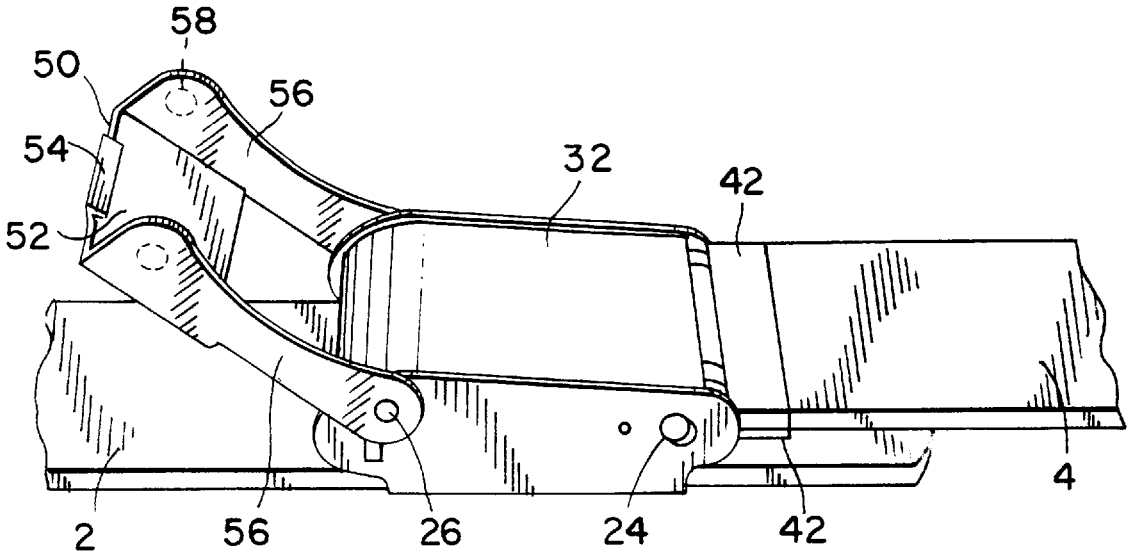
FIG. 3 is a front perspective view similar to that of FIG. 2 with the first lock mechanism secured.

With reference to FIG. 3, the first locking assembly is shown in the locked position with the upper surface of lock plate 32 approximately flush with the upper edges of sidewalls 14. As also shown in FIGS. 1–3, second locking member 50, comprising cover plate 52 joined at right angles to a pair of pivot arms 56, is mounted for rotation on pivot pin or transverse axle 26. The free ends of pivot arms 56 are provided with inwardly projecting bosses 58 which are positioned to engage openings or recesses 24 in sidewalls 14. As shown in a preferred embodiment of FIGS. 1–4, the pivot arms of the second locking member 50 are mounted adjacent the external surface of the frame member sidewalls. It will be understood that the sidewalls can alternatively be provided with bosses and the pivot arms provided with corresponding openings, or that sidewalls and pivot arms can be provided with a combination of openings and bosses to provide the second locking mechanism. Additional security and locking force can be attained by providing a plurality of bosses and corresponding openings or recesses in each of the sidewalls and adjacent pivot arms.

Figure 4:
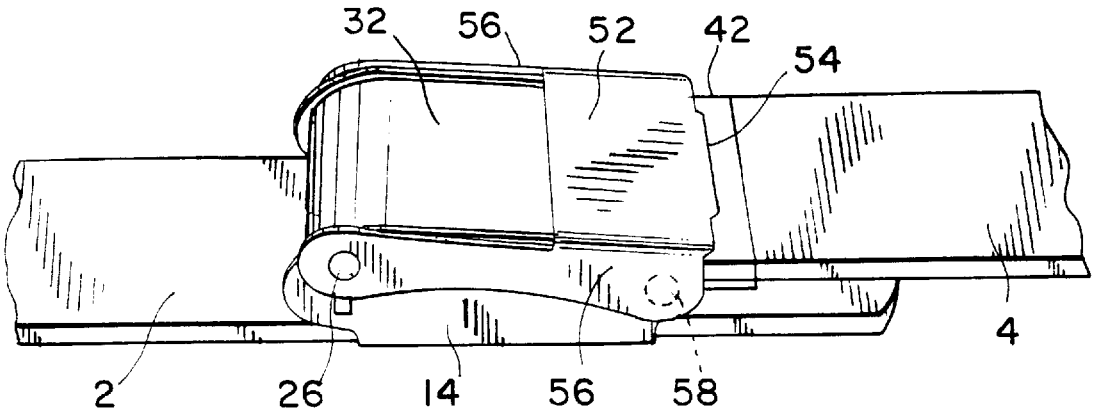
FIG. 4 is a front perspective view similar to that of FIG. 3 in which the second lock mechanism is secured.

With reference to FIG. 4, the second locking member 50 is shown rotated around pivot pin 26 and into the locked position with bosses 58 engaging openings or recesses 24 in sidewalls 14. In this locked position, cover plate 52 is in touching alignment or close proximity to the pivoting end of lock plate 32, and leading edge 54 is displaced from the surface of adjacent band 4 a distance that is sufficient to permit the insertion of a fingernail to lift locking member 50 from the locked position. The relationship of the pivot arms 56 in close proximity to sidewalls 14 is further illustrated in FIG. 5.

Figure 6:
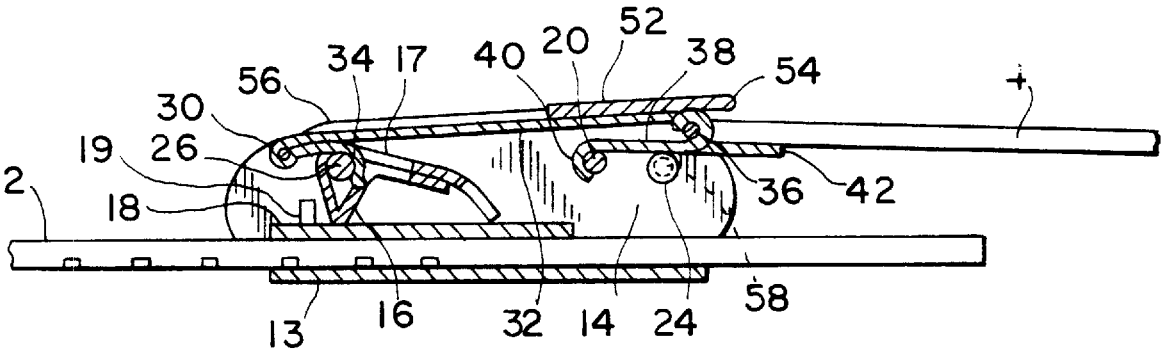
FIG. 6 is a cross-sectional view taken along line VI—VI of FIG. 5.

In the cross-sectional view of FIG. 6, the curved end 40 of hook plate 38 is positioned on bar 20. Pressure plate 18 holds a section of band 2 in a fixed, but adjustable position against frame member base plate 13 by virtue of the compressive force exerted by plate clamp 16. First locking member 34 secures lock plate 32 in position by the biasing force resulting from its contact with pivot pin 26 passing through clamp aperture 17. Cover plate 52 of second locking member 50 is secured in position over first locking member assembly 30 by the engagement of bosses 58 in sidewall openings 24.

Figure 7:
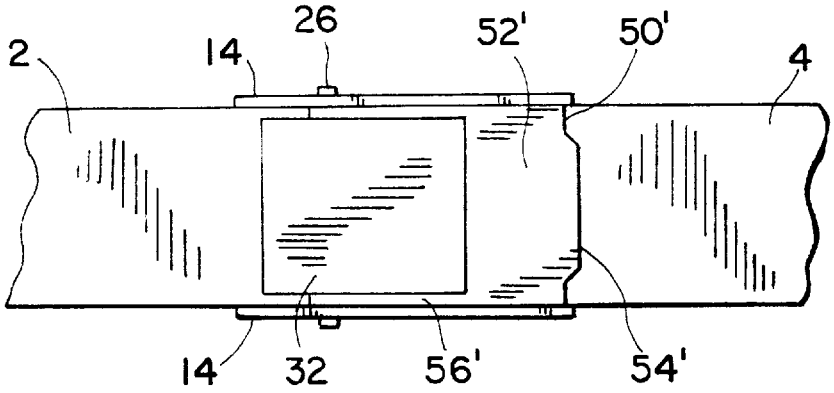
FIG. 7 is a top plan view of another preferred embodiment of the invention.

With reference to FIG. 7 there is shown another preferred embodiment where the pivot arms 56' of the second locking member 50' are positioned inside of the sidewalls 14 of frame member 12. As in the embodiment of FIGS. 1–6, pivot pin 26 secures locking member 50' for rotation from an open position to permit the closing of lock plate 32 of first locking assembly 30, to the closed position of FIG. 7 which prevents lock plate 32 from being disengaged. In this embodiment, bosses 58' (not shown) extend outwardly from pivot arms 56 to engage openings 24 in adjacent sidewalls 14. Alternatively, the frame members 14 can be provided with inwardly projecting bosses that engage openings (not shown) in the pivot arms to secure the second locking member in the closed position. The width of the locking plate 32' is correspondingly narrowed to provide clearance for the pivot arms 56'.

With reference to FIG. 8 there is shown yet another preferred embodiment of the invention where the cover plate 52" of the second locking member 50" extends from proximate the pivot pin 26 at one end of the pivot arms 56" to beyond the free end of band section 4. In this embodiment, cover plate 52" substantially covers lock plate 32 thereby precluding the accidental disengagement of the first locking assembly. In this embodiment, the pivot arms 56" are configured to provide the necessary clearance for the cover plate 52" above sidewalls 14. This latter configuration provides added security rendering it essentially impossible to lift the locking plate 32 without first raising the second locking member 50".

I claim:

1. A double locking safety clasp for securing the free ends of a watch band or bracelet comprising:

a frame member for receiving and retaining a section of a first band between a pair of sidewalls and a bar extending between the sidewalls of the frame member, a first locking member for pivotally mounting on the free end of a second section of the band, and a hook member for pivotally mounting on the free end of the second section of the band along an axis of rotation coincident with that of the first locking member, said hook member adapted to engage the bar on the frame member, lock engagement means on the frame member for engaging the first locking member to releasably secure the first locking member to the frame member, a second locking member having pivot arms pivotally mounted on the sidewalls for rotation to a locked position overlying the secured first locking member, and a plurality of bosses extending between the sidewalls and the second locking member and a corresponding plurality of openings adapted to engage said bosses to releasably secure the second locking member to said frame member in a locked position.

2. The clasp of claim 1 where the pivot arms are mounted proximate to the exterior surfaces of the sidewalls.

3. The clasp of claim 1 where the pivot arms are mounted on a transverse axle extending through openings in the sidewalls.

4. The clasp of claim 3 where said lock engagement means is a section of the transverse axle.

5. The clasp of claim 3 which further comprises a pressure plate and a pressure plate clamp and said clamp is mounted for rotation on said transverse axle for engaging said pressure plate.

6. The clasp of claim 1 sphere the pivot arms are joined by a cover plate that extends from partially down the pivot arms and terminates in a leading edge proximate the free ends of the pivot arms.

7. The clasp of claim 6 where the leading edge of the locked cover plate is positioned so that a fingernail can be inserted under said leading edge to raise said cover plate when the clasp is assembled to a watch band or bracelet.

8. The clasp of claim 1 where the pivot arms are mounted for rotation by means of bosses extending between each pivot arm and the adjacent side wall, which bosses project into corresponding openings in the adjacent surface.

9. The clasp of claim 8 where each of the free ends of the pivot arms is provided with at least one boss, and the adjacent side walls have a corresponding number of openings for receiving said at least one boss.

10. A method of double-locking the free ends of a watch band or bracelet, comprising the steps of:

providing a generally U-shaped frame member comprising a base and longitudinal sidewalls, a transverse bar extending between said sidewalls and a first lock engaging means;

securing a section of a first band to the frame member between the sidewalls;

providing a lock plate comprising a first locking element;

providing a hook member;

pivotally mounting the lock plate and the hook member on the end of the second band;

providing a second locking member comprising a cover plate and a pair of opposing pivot arms extending from said cover plate, one end of said pivot arms being configured for mounting on said frame member;

mounting the ends of said opposing pivot arms on said sidewalls for rotation from an open to a closed position; engaging said hook member on the transverse bar of the frame member;

rotating the lock plate to engage the first locking element with the engaging means to secure the lock plate to the frame member in a first locking action;

providing each of the pivot arms and/or the adjacent sidewalls with at least one boss to engage a corresponding opening in the other;

rotating the second locking member to position said cover plate over the first lock plate and said pivot arms adjacent said sidewalls; and engaging the bosses in the corresponding openings in the adjacent surfaces of the pivot arms and sidewalls to thereby lock said second locking member in position.

11. The method claim 10 where the pivot arms are mounted on the exterior surfaces of the sidewalls.

12. The method of claim 11 where the boss is provided in the pivot arm proximate the free end of the arm.

13. The method of claim 10 where the pivot arms are mounted for rotation by the engagement of bosses in the pivot arms with corresponding openings in the sidewalls.

14. The method of claim 10 where the pivot arms are rotationally mounted on the ends of a transverse axle extending through openings in the sidewalls.

15. The method of claim 10 where the movement of a leading edge of the cover plate to lock the second locking member terminates in spaced relation to the upper surface of the second band, whereby a fingernail can be inserted under said leading edge to raise the cover plate.

16. The method of claim 10 were said first locking element depends from the underside of said locking plate and is displaced from the leading edge of said locking plate towards the axis of rotation whereby the locking plate provides leverage for engaging and disengaging the first locking member.

* * * * *

UNITED STATES PATENT AND TRADEMARK OFFICE

CERTIFICATE OF CORRECTION

PATENT NO. : 5,870,803

DATED : February 16, 1999

INVENTOR(S) : Charlotte K. Jorst

It is certified that error appears in the above-identified patent and that said Letters Patent is hereby corrected as shown below:

Col. 5, claim 6, line 1, delete "sphere" and insert --where--.

Signed and Sealed this

First Day of June, 1999

*Attest:*

Q. TODD DICKINSON

*Attesting Officer*

*Acting Commissioner of Patents and Trademarks*